United States Patent [19]

Matsusaka et al.

[11] Patent Number: 4,838,816

[45] Date of Patent: Jun. 13, 1989

[54] ELECTRICAL TERMINAL HAVING A RECEPTACLE CONTACT SECTION OF LOW INSERTION FORCE

[75] Inventors: Yoshihide Matsusaka, Kawasaki; Kohji Aoyama, Tokyo; Masaro Noguchi, Sagamihara, all of Japan

[73] Assignee: AMP Incorporated, Harrisburg, Pa.

[21] Appl. No.: 665,339

[22] Filed: Oct. 26, 1984

[30] Foreign Application Priority Data

Dec. 27, 1983 [JP] Japan ..... 58-199108

[51] Int. Cl.[4] ..... H01R 4/24

[52] U.S. Cl. ..... 439/861; 439/395

[58] Field of Search ..... 339/258 R, 258 P, 258 S, 339/259 R, 97 R, 97 P, 98, 99 R

[56] References Cited

U.S. PATENT DOCUMENTS

| | | | |
|---|---|---|---|
| Re. 31,142 | 2/1983 | Simmons | 339/258 S |
| 3,977,757 | 8/1976 | Yurtin | 339/258 R |
| 4,068,915 | 1/1978 | Evans | 339/259 R |
| 4,139,256 | 2/1979 | Seidler | 339/258 R |
| 4,231,632 | 11/1980 | Badoz et al. | 339/97 R |
| 4,357,066 | 11/1982 | Cairns | 339/259 R |

*Primary Examiner*—Joseph H. McGlynn

*Attorney, Agent, or Firm*—Bruce J. Wolstoncroft

[57] ABSTRACT

An electrical terminal comprises a receptacle contact section having cantilever contact members extending from a bottom wall at forward and rear ends of the contact section, the contact members extend toward an upper wall and free ends of the contact members overlap and are spaced from each other so that, upon initial insertion of a matable contact into the contact section, a low insertion force is encountered and the insertion force increases gradually in proportion to the depth of insertion of the matable contact due to engagement between the overlapping free ends of the contact members so that a high contact pressure is obtained at the complete insertion of the matable contact in the receptacle contact section.

3 Claims, 2 Drawing Sheets

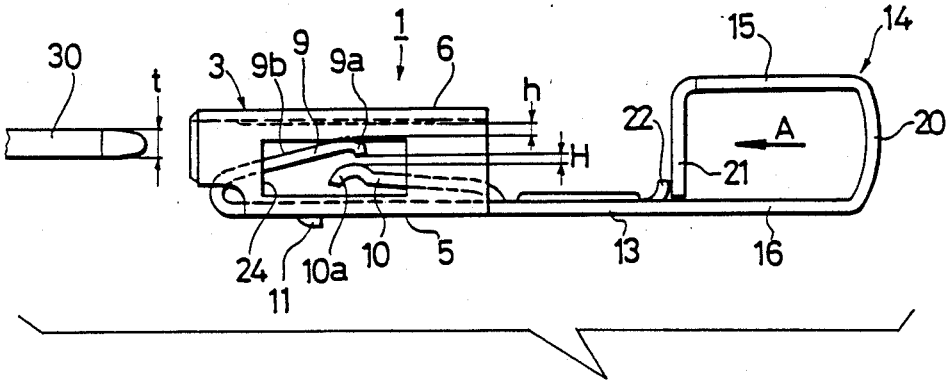
FIG. 2
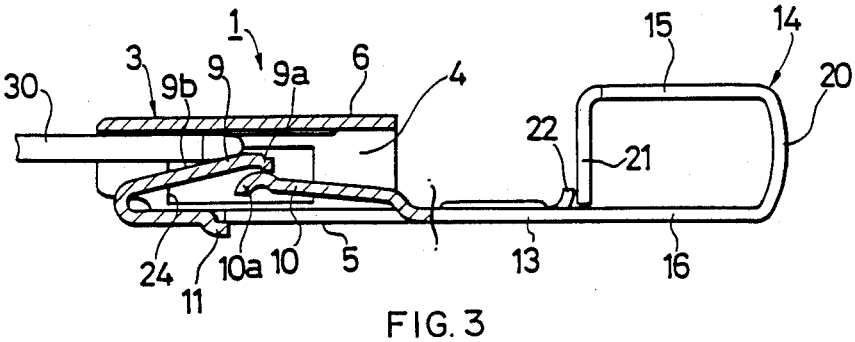
FIG. 3
FIG. 4
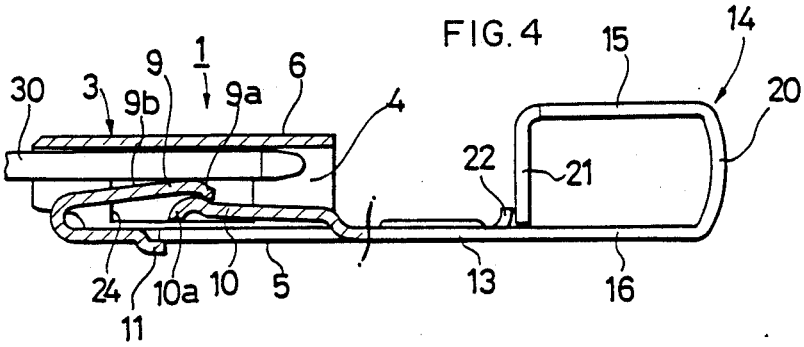

ELECTRICAL TERMINAL HAVING A RECEPTACLE CONTACT SECTION OF LOW INSERTION FORCE

FIELD OF THE INVENTION

The invention relates to an electrical terminal and more particularly to an electrical terminal having a receptacle contact section of low insertion force.

BACKGROUND OF THE INVENTION

Electrical terminals are known that have a receptacle contact section including a contact-receiving area for receiving a matable contact which includes a resilient contact member and a spring-assist member which are part of the receptacle contact section. These electrical termnals include a main resilient contact member which extends backward and into the contact-receiving area from the front end of the receptacle contact section and which is of a relatively long length and a spring-assist member extending from a rear portion of the receptacle contact section and which is of a relatively short length. The spring-assist member supports the main resilient contact member arm so as to supplement a spring force of the main resilient contact member so that a high contact pressure can be obtained when the receptacle contact section mates with a matable contact.

However, in this type of electrical terminal, since the main resilient contact member is supported at its central portion by a free end of the spring-assist member which is relatively rigid, the effective arm length of the main resilient contact member, which serves as a cantilever, is shortened and, as a result of this, the main resilient contact member is rigid so that the insertion force of the matable contact into the receptacle contact section is substantially increased. In such a case, if the receptacle contact section is plated with gold, the gold is worn through after a few engagements and disengagements so that the useful electrical life of the contact section is shortened. Also, in a multiple connector including many such contact sections, a large force is needed to mate and release the matable connectors.

SUMMARY OF THE INVENTION

The present invention of an electrical terminal having a receptacle contact section of low insertion force overcomes the above-mentioned problems. The object of the present invention is to provide an electrical terminal having a receptacle contact section into which a matable contact is inserted with a low insertion force and which ensures a reliable and high contact pressure with the matable contact when the matable contact is fully inserted into the contact section.

According to the present invention, an electrical terminal comprises a receptacle contact section having cantilever contact members extending from a bottom wall at forward and rear ends of the contact section, the contact members extend toward an upper wall and free ends of the contact members overlap and are spaced from each other so that, upon initial insertion of a matable contact into the contact section, a low insertion force is encountered and the insertion force increases gradually in proportion to the depth of insertion of the matable contact due to engagement between the overlapping free ends of the contact members so that a high contact pressure is obtained at the complete insertion of the matable contact in the receptacle contact section.

According to another feature of the present invention, a wire-terminating section of an electrical terminal comprises parallel plates spaced from each other and connected together by bights, wire-receiving slots in the plates and an extension of one of the plates engages the other of the plates and is disposed adjacent a lance in the other plate so that an insertion member can engage the extension between the bights and force the terminal into a terminal-receiving cavity of a housing.

BRIEF DESCRIPTION OF THE DRAWINGS

FIG. 2 is a side elevational view of the electrical terminal and matable contact of FIG. 1.

FIG. 3 is a part cross-sectional view of the receptacle contact section in the initial insertion position of the matable contact therein.

FIG. 4 is a part cross-sectional view of the receptacle contact section in the complete insertion position of the matable contact therein.

DETAILED DESCRIPTION OF THE INVENTION

Figure 1:
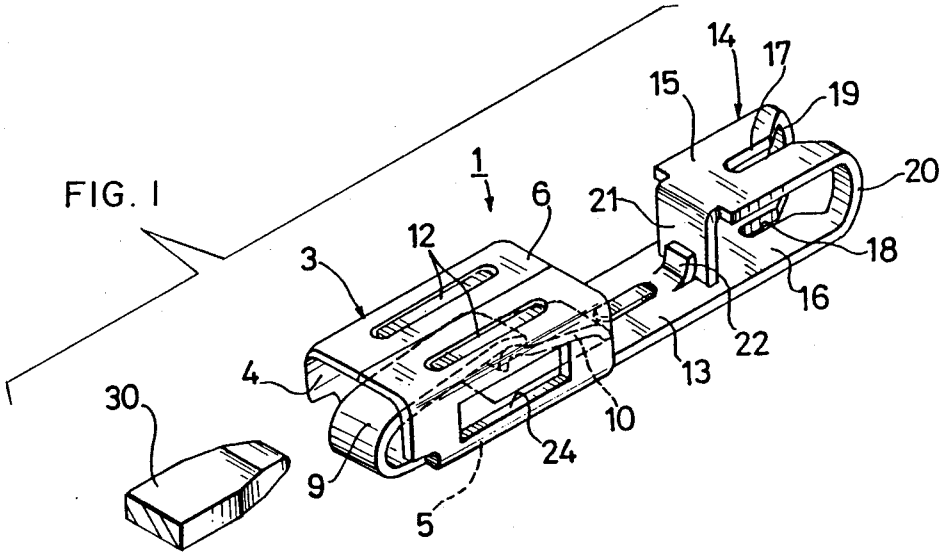
FIG. 1 is a perspective view of the electrical terminal according to the present invention with a matable contact exploded therefrom.
Figure 5:
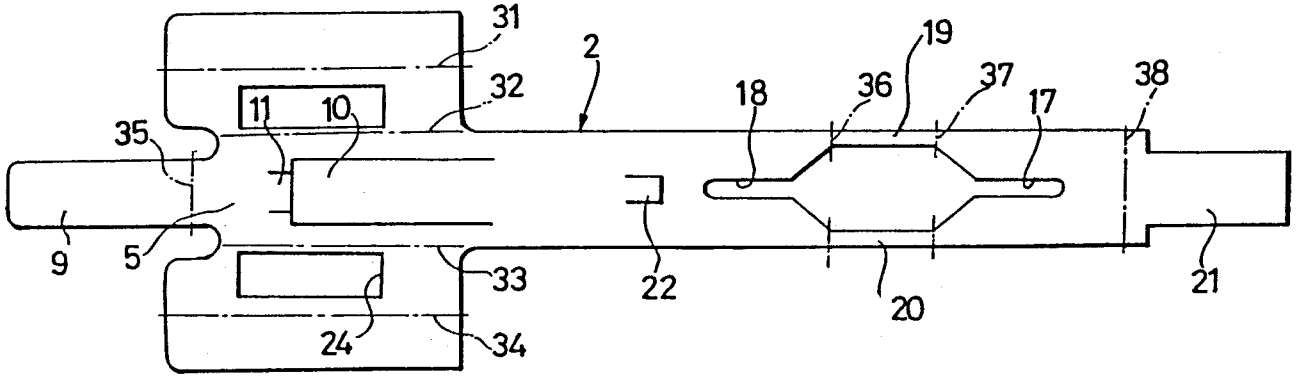
FIG. 5 is a top plan view of the metal blank from which the electrical terminal of FIG. 1 is formed.

The electrical terminal 1 according to the present invention is made from a metal sheet having desirable conductive and spring characteristics by stamping and folding a stamped blank along lines 31–38 shown in FIG. 5.

Electrical terminal 1 has a receptacle contact section 3, the transverse cross-section of which is of a rectangular shape, and which has a contact-receiving area 4 for receiving therein a matable contact 30 having a tab configuration. Receptacle contact section 3 includes a resilient contact member 9 which is bent at a front end of the contact section 3 along folding line 35 (FIG. 5) and which is integral with a bottom wall 5. Resilient contact member 9 extends backward within contact-receiving area 4 in a direction away from bottom wall 5 as a cantilever contact member and provides a contact surface 9b for electrical engagement with matable contact 30, at the forward portion in a longitudinal direction thereof. An arcuate free end **9*a* of contact member 9 is positioned at the longitudinal central portion of contact-receiving area 4 with a gap h between an upper wall 6 and free end 9*a*. Gap h is less than a thickness t of matable contact 30 to be inserted between wall 6 and contact member 9**.

Spring-assist member 10 is formed out of bottom wall 5 by stamping therefrom and extends forward within contact-receiving area 4 from a rear portion of bottom wall 5 and in a direction away from bottom wall 5. A free end **10*a* of spring-assist member 10 is arcuate-shaped and is positioned adjacent arcuate free end 9*a* of contact member 9. Both members 9, 10 are substantially the same length, and free ends 9*a*, 10*a*** are normally spaced apart by gap H.

Bottom wall 5 has a projection 11 for engagement with a shoulder formed in a terminal-receiving cavity of an insulating housing (not shown) so that terminal 1 is retained in the housing.

Contact section 3 has at the inner surface of upper wall 6 two inwardly-projecting beads 12 which extend in the longitudinal direction of upper wall 6. Inwardly-projecting beads 12 provide a contact surface for matable contact 30 to move along and they serve to reduce the frictional resistance of contact 30 when it is inserted in contact-receiving area 4.

Terminal 1 has an extension 13 which extends backward as part of bottom wall 5 and provides a wire connecting section 14 which is formed by bending along folding lines 36–38 (FIG. 5). The wire connecting section 14 includes a pair of parallel plates 15, 16 which are spaced from each other. Each of plates 15, 16 has wire-receiving slots 17, 18 and plates 15, 16 are interconnected by bights 19, 20. A plate 21 integral with and as an extension of plate 15 extends toward plate 16. A free end of the plate 21 abuts plate 16 and engages a lance 22 extending outwardly from extension 13. Lance 22 serves to prevent plate 21 from being deformed in the direction of arrow A in FIG. 2 when terminal 1 is inserted into the terminal-receiving cavity of the housing by pressing against plate 21 with an insertion member (not shown) which is inserted between bights 19, 20. Insulated electrical conductors (now shown) are electrically and mechanically terminated in wire-receiving slots 17, 18 in a known manner.

When matable contact 30 is inserted into contact-receiving area 4 of contact section 3, matable contact 30 engages resilient contact member 9, as shown in FIG. 3, and presses the contact member 9 toward bottom wall 5. In this initial inserting position of the contact 30, the contact 30 receives only the spring force of resilient contact member 9 so that the insertion force is small. Contact 30 is then further inserted as shown in FIG. 4, and resilient contact member 9 is further depressed so that its arcuate free end **9*a* engages free end 10*a* of spring-assist member 10 and presses member 10 toward bottom wall 5. In this complete insertion position of the contact 30 between beads 12 and member 9, contact 30 receives the combined spring force of resilient contact member 9 and spring-assist member 10** so that a high contact pressure can be obtained.

According to the present invention, as is described above, the construction is such that the spring force of the resilient contact member only is applied to the matable contact in the initial insertion position of the matable contact in the contact-receiving area of a receptacle contact section of an electrical terminal, and the combined spring force of the resilient contact member and the spring-assist member is applied thereto at the complete insertion position of the matable contact within the contact-receiving area. Consequently, a low initial insertion force of the matable contact into the receptacle contact section can be obtained, and also, a high contact pressure can be obtained at the complete insertion position. In addition, both of the spring contact members constitute an independent cantilever, respectively, and the overlapping free ends with a gap therebetween can be displaced gently over a wide range. Therefore, if the matable contact is inserted into the receptacle contact section at an inappropriate insertion angle and, as a result, the resilient members are exceedingly displaced, the members are not permanently deformed. This makes possible electrical connections between a matable contact a receptacle contact section having various thicknesses. Furthermore, the ease of displacement of both free ends of the resilient members ensures smooth insertion of the matable contact after the initial insertion and the insertion force increases gradually in proportion to the depth of the insertion, and thus the operation efficiency increases.

Due to initial low insertion forces required to mate the matable contacts in the receptacle contact sections and the insertion forces increasing gradually until complete insertion takes place, the present invention lends itself to connectors including many receptacle contact sections according to the present invention.

We claim:

1. An electrical terminal comprising:

a receptacle contact section having a bottom wall and an upper wall;

a first cantilever spring member extending outwardly from a forward end of said bottom wall and being bent back so as to extend backward into said contact section along the bottom wall at an inclined angle relative to the bottom wall, a free end of the contact member spaced from said upper wall a distance less than the thickness of a matable contact member;

a second cantilever spring member being formed from said bottom wall and having a free end disposed beneath the free end of said first spring member in overlapping relationship but spaced therefrom;

said first spring member being initially engaged by the matable contact member upon insertion of the contact member into the contact section between the upper wall and the first spring member so that the insertion force at this position is low, and upon further insertion of the matable contact member into the contact section, the insertion force gradually increase because of the engagement between the free ends of the spring members, and when the contact member is fully inserted into the contact section, high contact pressure is applied to the contact member by combined spring forces of the spring member;

a wire-terminating section is located adjacent said receptacle contact section, said wire-terminating section including parallel plate members spaced from each other, said plate members having wire-receiving slots therein;

bights connecting said plate members together at the ends having the entrances to the wire-receiving slots;

an extension of one plate member engaging the other plate member so that said bights and said extension maintain said plate members parallel; and means provided by the other plate member to maintain the extension positioned at the other plate member so that when an insertion member is positioned between the bights in engagement with said extension, the extension is supported when the insertion member applies force onto the extension to insert the terminal into a terminal-receiving cavity of a housing.

2. An electrical terminal according to claim 1, wherein said wire-receiving slots are oriented so that an electrical conductor is forcefully terminated therein and is disposed normal to the longitudinal axis of the terminal.

3. An electrical terminal according to claim 1, wherein the second cantilever spring member extends forward from a back end of said bottom wall.

* * * * *